US011864710B2

(12) United States Patent
Woo

(10) Patent No.: US 11,864,710 B2
(45) Date of Patent: Jan. 9, 2024

(54) DISHWASHER AND CONTROL METHOD THEREOF

(71) Applicant: LG ELECTRONICS INC., Seoul (KR)

(72) Inventor: Sang Woo Woo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/398,607

(22) Filed: Aug. 10, 2021

(65) Prior Publication Data

US 2022/0053993 A1 Feb. 24, 2022

(30) Foreign Application Priority Data

Aug. 18, 2020 (KR) ..... 10-2020-0103256

(51) Int. Cl.

| | |
|---|---|
| ***A47L 5/00*** | (2006.01) |
| ***A47L 15/22*** | (2006.01) |
| ***A47L 15/23*** | (2006.01) |
| ***A47L 15/42*** | (2006.01) |
| ***A47L 15/00*** | (2006.01) |

(52) U.S. Cl.

CPC ..... *A47L 15/23* (2013.01); *A47L 15/0028* (2013.01); *A47L 15/22* (2013.01); *A47L 15/428* (2013.01); *A47L 15/4221* (2013.01); *A47L 15/4282* (2013.01); *A47L 15/4289* (2013.01); *A47L 15/4295* (2013.01); *A47L 2401/04* (2013.01); *A47L 2501/20* (2013.01)

(58) Field of Classification Search

None

See application file for complete search history.

(56) References Cited

U.S. PATENT DOCUMENTS

| | | | |
|---|---|---|---|
| 7,935,194 | B2 | 5/2011 | Rolek |
| 10,383,504 | B2 | 8/2019 | Fountain |
| 2005/0011544 | A1 | 1/2005 | Rosenbauer et al. |
| 2011/0303250 | A1 | 12/2011 | Delgado et al. |
| 2012/0138092 | A1* | 6/2012 | Ashrafzadeh ..... A47L 15/4295 134/57 D |
| 2012/0279536 | A1 | 11/2012 | Adams et al. |
| 2013/0139854 | A1 | 6/2013 | Lee et al. |
| 2017/0202426 | A1 | 7/2017 | Bosen et al. |

FOREIGN PATENT DOCUMENTS

| | | | |
|---|---|---|---|
| CN | 107752937 | A | 3/2018 |
| DE | 102009002667 | A1 | 10/2010 |
| DE | 102014215660 | A1 | 1/2016 |
| EP | 2572624 | A1 | 3/2013 |
| EP | 2954830 | A1 | 12/2015 |
| WO | 2011132356 | A1 | 10/2011 |

* cited by examiner

*Primary Examiner* — Levon J Shahinian

(74) *Attorney, Agent, or Firm* — Bryan Cave Leighton Paisner LLP

(57) ABSTRACT

A dishwasher in one embodiment is provided with a spray arm, and the spray arm is provided individually with areas configured to spray water to a first spray area and a second spray area, and sprays water to the first spray area to entirely wash objects to be washed accommodated in the dishwasher and sprays water to the second spray area to wash objects to be washed with remaining contaminants by applying a great impact on the object to be washed with remaining contaminants.

11 Claims, 6 Drawing Sheets

DISHWASHER AND CONTROL METHOD THEREOF

CROSS-REFERENCE TO RELATED APPLICATION

This application claims priority to and the benefit of Korean Patent Application No. 10-2020-0103256, filed on Aug. 8, 2018, the disclosure of which is incorporated herein by reference in its entirety.

TECHNICAL FIELD

Disclosed herein are a dishwasher and a control method thereof having a structure that ensures improvement in washing performance.

BACKGROUND

Details in the background section do not constitute the related art but are given only as background information concerning the subject matter of the present disclosure.

Dishwashers are devices that spray water to an object to be washed such as a cooking vessel, a cooking tool and the like, stored in the dishwasher, to wash the object to be washed. The water used for a wash can include detergent.

The dishwasher is ordinarily comprised of a wash tub forming a wash space, a storage disposed in the wash tub and configured to accommodate an object to be washed, a spray arm configured to spray water to the storage, and a sump configured to store water and to supply water to the spray arm.

The dishwashers can help users to reduce time and efforts spent on washing the dishes after a meal, thereby improving user convenience.

When the dishwashers are used to wash objects to be washed, contaminants can remain on some of the objects to be washed, even after a wash process in which water sprays ends.

In this case, the users ascertain a cooking vessel with the remaining contaminants, and secondarily wash the cooking vessel to remove the remaining contaminants from the cooking vessel.

The secondary wash causes additional work to users since the users need to spend additional time and efforts on the secondary wash, thereby making the users reluctant to purchase and use the dishwashers. Thus, there is a growing need for a dishwasher that can help to reduce the burden of the secondary wash.

SUMMARY

Technical Problem

The present disclosure is directed to a dishwasher having a structure that may help to ascertain an object to be washed with remaining contaminants after a process of washing objects to be washed ends, and to perform an additional process of removing the remaining contaminants.

The present disclosure is also directed to a dishwasher that may be provided with a means of ascertaining remaining contaminants.

The present disclosure is also directed to a control method of a dishwasher that may remove remaining contaminants effectively.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Technical Solution

A dishwasher in one embodiment may be provided with a spray arm, and the spray arm may be provided separately with areas configured to spray water to a first spray area and a second spray area, and may spray water to the first spray area to entirely wash objects to be washed stored in the dishwasher and may spray water to the second spray area to wash objects to be washed with remaining contaminants by applying a great impact on the object to be washed with remaining contaminants.

The dishwasher in one embodiment may be provided with a camera that is disposed at the spray arm and ascertains an object to be washed with remaining contaminants.

A control method of a dishwasher in one embodiment may include operating in an ordinary wash mode to entirely wash objects to be washed stored in the dishwasher and then operating in an intensive wash mode to intensively wash the ascertained object to be washed with remaining contaminants.

A dishwasher in one embodiment may include a wash tub configured to accommodate an object to be washed, a spray arm rotatably disposed in the wash tub, configured to spray water to an object to be washed and provided with a plurality of spray areas that are separate from each other, a flow path diverter disposed at the spray arm and configured to selectively open and close a flow of water to the plurality of spray areas, a first actuator configured to rotate the spray arm, a second actuator configured to rotate the flow path diverter, and a camera disposed at the spray arm, wherein the spray areas include a first spray area, and a second spray area being separate from the first spray area and having at least one of an amount of sprayed water or a spray speed greater than that of the first spray area.

The spray arm may be provided with a mounting part, onto which the flow path diverter is mounted, at a rotation center thereof, and the mounting part may be provided with a central hole which is formed in a central portion of the mounting part and to which a coupling projection formed at the flow path diverter is fitted, a first connecting hole formed respectively on both sides of the central portion and connected to the first spray area, and a second connecting hole spaced circumferentially from the first connecting hole and connected to the second spray area.

The spray arm may include a first wall configured to separate a pair of first connecting holes and a pair of first spray areas, and a second wall configured to separate the first connecting hole and the second connecting hole and to separate the first spray area and the second spray area.

The flow path diverter may include the coupling projection protruding toward the mounting part in a ring shape at a position corresponding to the central hole of the mounting part in a central portion of the flow path diverter, a dent part formed in a way that the flow path diverter is partially dent on both sides of the coupling projection and configured to selectively open any one of the first connecting hole and the second connecting hole as a result of rotation, and a closing part formed as a portion of the flow path diverter except for the dent part, and configured to selectively close any one of the first connecting hole and the second connecting hole as a result of rotation.

In the dishwasher of one embodiment, the mounting part may be provided with a first protrusion, which is configured to guide the flow path diverter such that the flow path diverter is coupled to the mounting part and protrudes toward the flow path diverter in a ring shape, on an outer edge thereof, and the flow path diverter may be provided with a second protrusion, which has a predetermined width and protrudes toward the mounting part along an outer edge of the flow path diverter, on the outer edge thereof.

A rotation shaft of the second actuator may be coupled to a rotation center of the flow path diverter such that the second actuator rotates the flow path diverter, and the flow path diverter may selectively open any one of the first connecting hole and the second connecting hole as a result of rotation of the dent part.

A rotation shaft of the first actuator may be spaced from the rotation center of the spray arm, a first gear may be coupled to the rotation center of the spray arm, a second gear may be coupled to the rotation shaft of the first actuator, and the first gear and the second gear may be coupled to each other.

In the dishwasher of one embodiment, the camera may be disposed in the second spray area.

The spray arm may be formed into a bar, the first spray area may be disposed in both end portions of the spray arm with respect to the rotation center of the spray arm, and the second spray area may be disposed in one end portion of the spray arm in a way that the second spray area is separate from the first spray area.

A plurality of first spray holes through which water sprays may be formed in the first spray area, at least one of second spray holes through which water sprays may be formed in the second spray area, the first spray holes may be disposed in a lengthwise direction of the spray arm at intervals, and when a plurality of second spray holes are provided, the second spray holes may be densely disposed in a specific area of the spray arm.

At least one of second spray holes through which water sprays may be formed in the second spray area, and the camera may be disposed near the second spray hole.

A control method of a dishwasher in one embodiment may include washing an object to be washed by spraying water through a first spray area included in a spray arm, determining whether contaminants remain on the object to be washed based on an image captured by a camera disposed at the spray arm, allowing a second spray hole disposed in a second spray area of the spray arm to approach the contaminants, as a result of operation of a first actuator, diverting a flow path of water such that a flow path diverter disposed at the spray arm blocks a flow of water to the first spray area and the water flows to the second spray area, as a result of operation of a second actuator, and washing a portion with the remaining contaminants by spraying water to the second spray hole.

In the control method of one embodiment, washing a portion with the remaining contaminants may include allowing the spray arm to make reciprocating rotations such that the second spray hole makes reciprocating rotations in a range of predetermined angles at a position near the contaminants.

Advantageous Effect

According to the present disclosure, a spray arm may be provided with a first spray area and a second spray area separately, and may spray water to the first spray area in an ordinary wash mode and spray water to the second spray area in an intensive wash mode to wash an object to be washed, thereby effectively removing contaminants remaining on a cooking vessel.

According to the present disclosure, a camera may be disposed in the first spray area of the spray arm, and the camera may approach a position where contaminants remain and may ascertain whether there are contaminants and a position where contaminants are present and the like more accurately.

According to the present disclosure, the spray arm may make reciprocating rotations such that a second spray hole makes reciprocating rotations in a range of predetermined angles at a position close to contaminants in the intensive wash mode, thereby ensuring improvement in washing efficiency.

Specific effects are described along with the above-described effects in the section of Detailed Description.

BRIEF DESCRIPTION OF DRAWING

The accompanying drawings constitute a part of the specification, illustrate one or more embodiments in the disclosure, and together with the specification, explain the disclosure, wherein.

DETAILED DESCRIPTION

Figure 1:
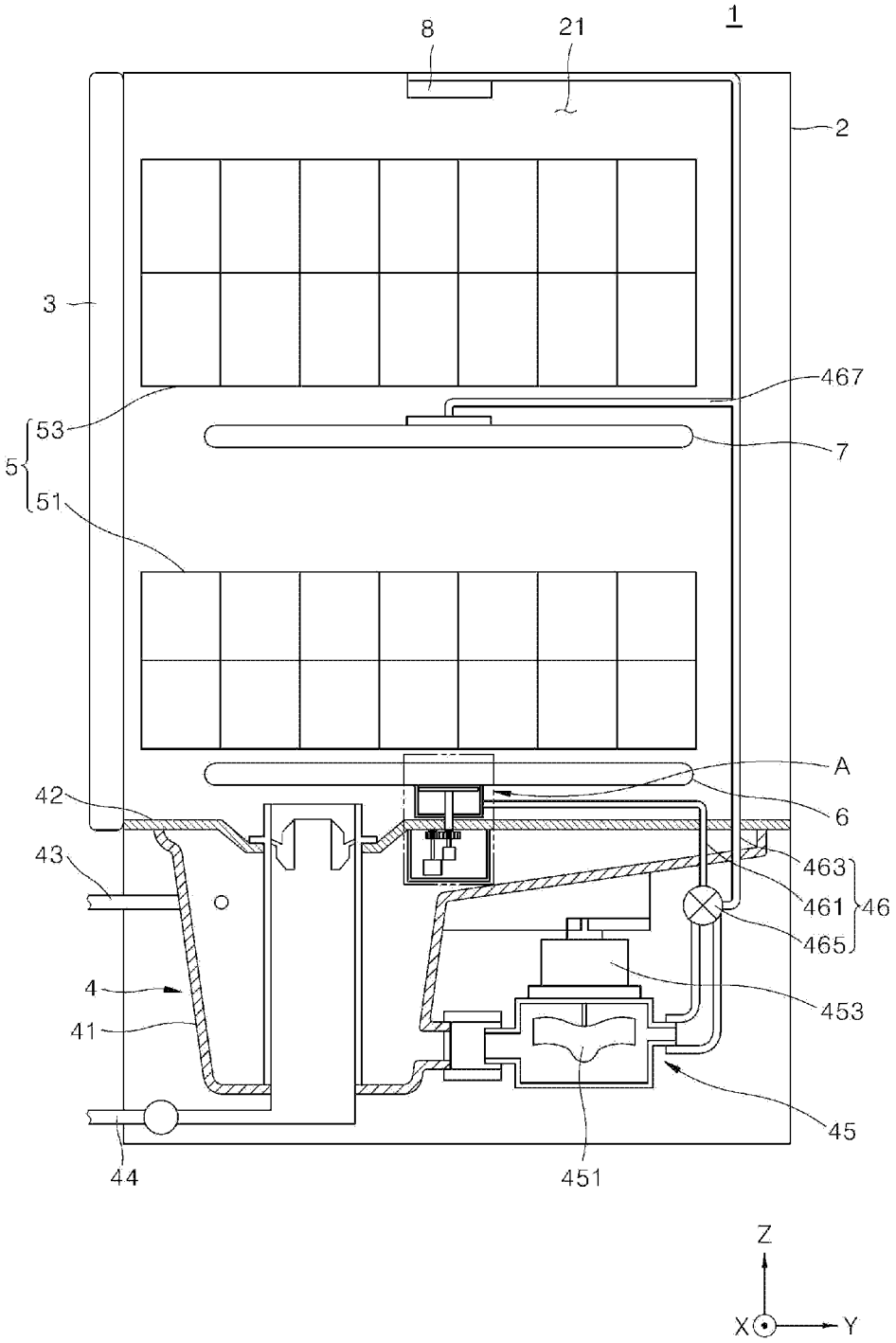
FIG. 1 is a cross-sectional view showing a dishwasher in one embodiment.

The above-described aspects, features and advantages are specifically described hereunder with reference to the accompanying drawings such that one having ordinary skill in the art to which the present disclosure pertains can easily implement the technical spirit of the disclosure. In the disclosure, detailed description of known technologies in relation to the disclosure is omitted if it is deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

In the drawings, a direction, in which components are disposed, is indicated using a rectangular coordinate system (x, y, z).

FIG. 1 is a cross-sectional view showing a dishwasher 1 in one embodiment.

Referring to FIG. 1, the dishwasher 1 may include a housing forming an exterior, a wash tub 2 forming a wash space 21 in the housing and configured to accommodate an object to be washed, a door 3 configured to selectively open and close the wash space 21, a sump 4 disposed in a lower portion of the wash tub 2 and configured to store wash water, a storage 5 disposed in the wash tub 2 and configured to accommodate an object to be washed, and spray arms 6, 7, 8 configured to spray wash water toward an object to be washed stored in the storage 5. The object to be washed may include a cooking vessel such as a bowl, a dish, a spoon, chopsticks and the like, and other cooking tools. Hereunder, the object to be washed may be referred to as a cooking vessel, for example.

The wash tub 2 may form the wash space 21 configured to accommodate an object to be washed, and the storage 5 and the spray arms 6, 7, 8 may be disposed in the wash space 21. The wash tub 2 may have one open surface, and the one open surface may be opened and closed by the door 3.

The door 3 may be swivably coupled to the housing and may selectively open and close the wash space 21. For example, a lower portion of the door 3 may be hinge-coupled to the housing. In this case, the door 3 may rotate with respect to a hinge to open and close the wash tub 2. As a result of the opening of the door 3, the storage 5 may be withdrawn out of the dishwasher 1, and the storage 5 withdrawn outward may be supported by the door 3.

The sump 4 may include a storing part 41 configured to store wash water, a sump cover 42 configured to divide the storing part 41 and the wash tub 2, a water supplier 43 configured to supply water to the storing part 41 from the outside, and a water drain 44 configured to drain water outward from the storing part 41, and a water supply pump 45 and a supply path 46 configured to supply water from the storing part 41 to the spray arms 6, 7, 8.

The sump cover 42 may be disposed in an upper portion of the sump 4 and may divide the wash tub 2 and the sump 4. The sump cover 42 may be provided with a plurality of return holes for returning wash water sprayed to the wash space 21 through the spray arms 6, 7, 8. That is, the wash water sprayed from the spray arms 6, 7, 8 may fall to a lower portion of the wash space 21 and may be returned to the storing part 41 of the sump 4 through the sump cover 42.

The water supply pump 45 may be disposed in a lateral portion or a lower portion of the storing part 41 and supply wash water to the spray arms 6, 7, 8.

One end of the water supply pump 45 may connect to the storing part 41 and the other end may connect to the supply path 46. The water supply pump 45 may be provided therein with an impeller 451, a motor 453 and the like. When power is supplied to the motor 453, the impeller 451 may rotate, and water in the storing part 41 may be supplied to the spray arms 6, 7, 8 through the supply path 46.

The supply path 46 may selectively supply wash water supplied by the water supply pump 45 to the spray arms 6, 7, 8.

The supply path 46 may include a first supply path 461 connected to a lower spray arm 6, a second supply path 463 connected to an upper spray arm 7 and a top nozzle 8, and a supply path diverter valve 465 configured to selectively open and close the supply paths 461, 463, 467. The supply path diverter valve 465 may control each of the supply paths 461, 463, 467 such that each of the supply paths 461, 463, 467 is opened consecutively or simultaneously.

Additionally, at least one storage 5 for storing an object to be washed may be included in the wash space 21. The dishwasher 1 is provided with two storages in FIG. 1, for example, but not limited. That is, the dishwasher 1 may be provided with a single storage or three or more storages. In this case, the number of spray arms may vary depending on the number of storages.

The storage 5 may include a lower rack 51 and an upper rack 53 for storing an object to be washed. The lower rack 51 may be disposed on the sump 4, and the upper rack 53 may be disposed further upward than the lower rack 51. The lower rack 51 and the upper rack 53 may be withdrawn outward through one open surface of the wash tub 2. To this end, the wash tub 2 may be provided with a rail on an inner circumferential surface thereof, and the racks 51, 53 may be provided with a wheel in lower portions thereof. A user may withdrawn the storage 5 outward to store an object to be washed, or to take out the object washed after a wash process.

The spray arm may be disposed in the wash tub 2 and may spray wash water toward an object to be washed in the storage 5.

The spray arm may include a lower spray arm 6, an upper spray arm 7, and a top nozzle 8. The lower spray arm 6 may be rotatably mounted onto the sump cover 42 and may spray wash water toward an object to be washed storage in the lower rack 51.

The upper spray arm 7 may be disposed over the lower spray arm 6 and may spray wash water toward an object to be washed storage in the upper rack 53. The top nozzle 8 may be disposed in an upper portion of the wash space 21 and may spray wash water to the lower rack 51 and the upper rack 53.

As described above, the first supply path 461 may supply wash water to the lower spray arm 6, and the second supply path 463 may supply wash water to the upper spray arm 7 and the top nozzle 8.

Hereunder, a structure of the lower spray arm 6 is specifically described with reference to FIGS. 2 to 8. The below-described structure of the lower spray arm 6 may be applied to a structure of the upper spray arm 7 identically or similarly.

Figure 2:
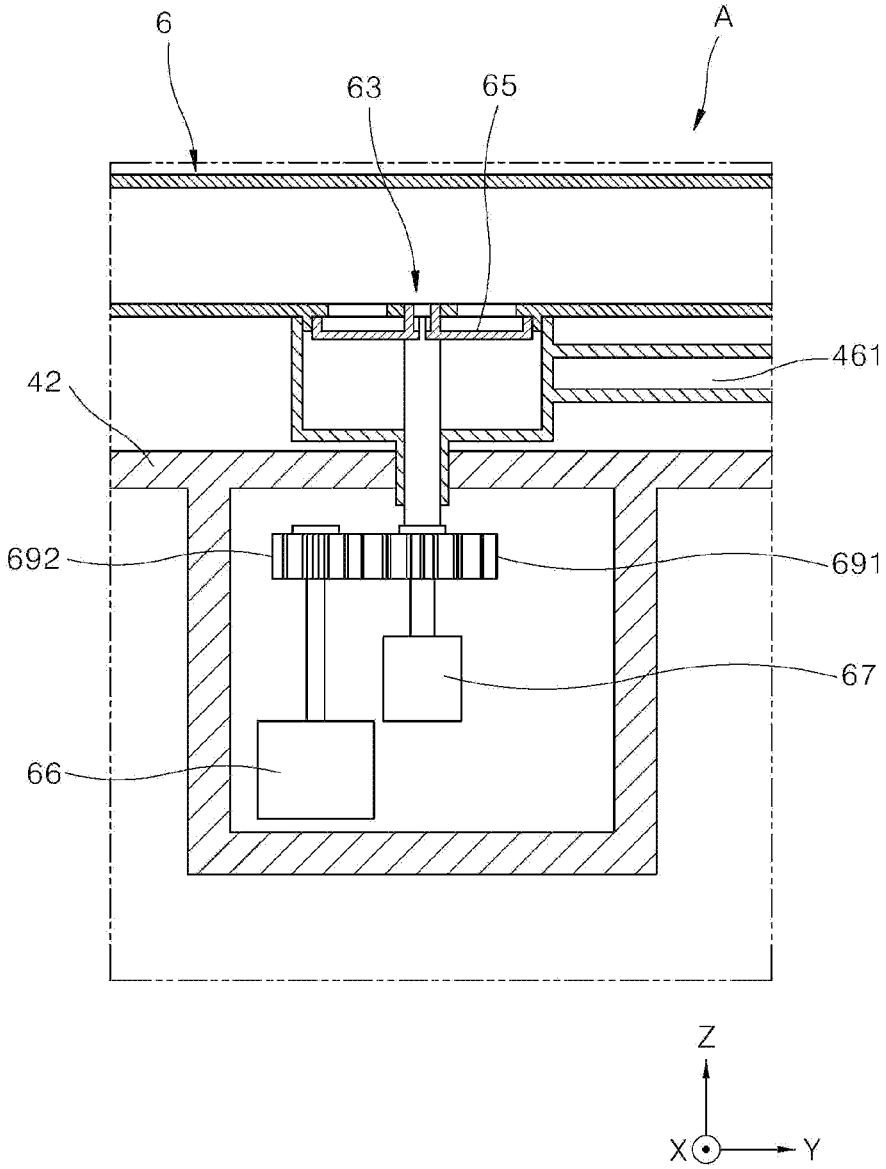
FIG. 2 is an enlarged view showing portion A in FIG. 1.
Figure 3:
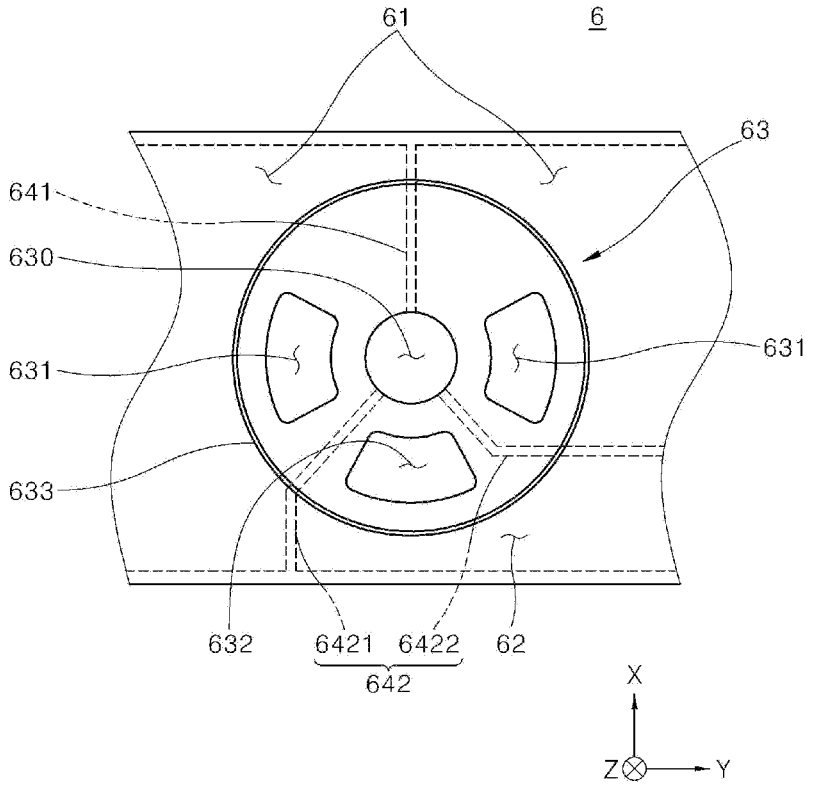
FIG. 3 is a view showing a part of a bottom surface of a spray arm in one embodiment.
Figure 4:
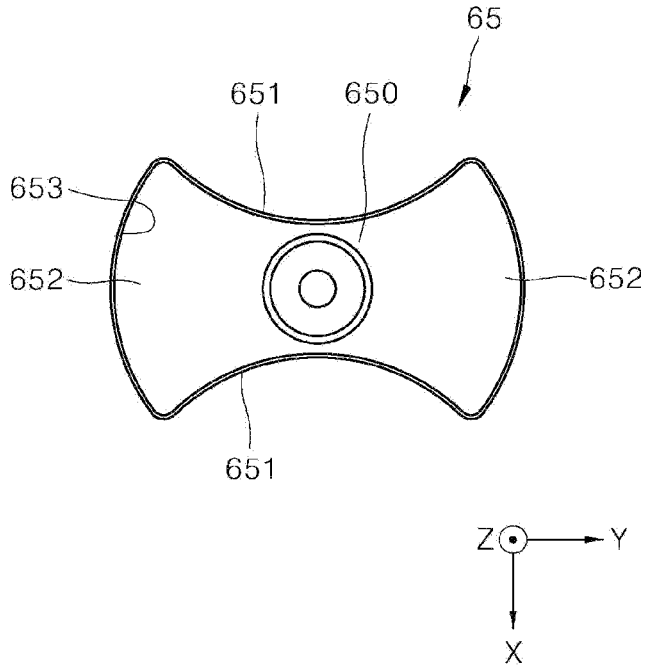
FIG. 4 is a plan view showing a flow path diverter in one embodiment.

FIG. 2 is an enlarged view showing portion A in FIG. 1. FIG. 3 is a view showing a part of a bottom surface of a spray arm 6 in one embodiment. FIG. 4 is a plan view showing a flow path diverter 65 in one embodiment.

The spray arm 6 may be rotatably disposed in the wash tub, may spray water to an object to be washed, and may be provided with a plurality of spray areas that are separate from each other.

The spray arm 6 may include a flow path, in which wash water, i.e., water flowing from the second supply path 463 flows, and a spray hole which connects to the flow path and is exposed to an outside of the spray arm 6. An area where the flow path and spray hole are disposed is referred to as a spray area in the disclosure.

As illustrated in FIG. 3, the spray area may include a first spray area 61 and a second spray area 62. The second spray area 62 may be formed in a way that the second spray area is separate from the first spray area 61. Accordingly, water flowing into the spray arm 6 may flow in the first spray area 61 and the second spray area 62 that are separate from each other, and water flowing in the first spray area 61 and the second spray area 62 may not be mixed.

The first spray area 61 and the second spray area 62 may be formed into a space in the spray arm 6. For example, the first spray area 61 and the second spray area 62 may be formed into spaces in the spray arm 6 as a result of molding manufacturing.

When cooking vessels storage in the lower rack 51 are entirely washed at the same time during a process of washing the cooking vessels, water may flow to the first spray area 61 to wash the cooking vessels entirely. To this end, the first spray area 61 may be formed entirely across the spray arm 6 in a lengthwise direction of the spray arm 6 such that the spray arm 6 rotating sprays water entirely to the cooking vessels storage in the lower rack 51.

When contaminants are left on a cooking vessel disposed at a specific position of the lower rack 51 after the cooking vessels are entirely washed at the same time, water may flow to the second spray area 62 to wash the left contaminants.

Hereunder, a mode in which water flows to the first spray area 61 to entirely wash cooking vessels is referred to as an ordinary wash mode, and a mode in which water flows to the second spray area 62 to wash contaminants left on some cooking vessels is referred to as an intensive wash mode.

The intensive wash mode may differ from the ordinary wash mode in that sprayed water needs to give a great impact on a cooking vessel to wash contaminants that are not washed and firmly attached onto a surface of the cooking vessel.

To this end, at least one of an amount of sprayed water and a spray speed in the second spray area 62 may be greater than that in the first spray area 61.

To increase an amount of sprayed water in the second spray area 62, an output of the water supply pump 45 may increase in the intensive wash mode in which water is sprayed in the second spray area 62, for example. Additionally, to increase a spray speed of water in the second spray area 62 in a state in which the output of the water supply pump 45 is the same, a total cross-sectional area of spray holes in the second spray area 62 may be less than a total cross-sectional area of spray holes in the first spray area 61, for example.

Since the coking vessels storage in the lower rack 51 are entirely washed in the ordinary wash mode, the first spray area 61 may be formed entirely across the spray arm 6 in the lengthwise direction thereof. In the intensive wash mode, some cooking vessels storage in the lower rack 51 are washed. Accordingly, the second spray area 62 may be formed partially in the spray arm in the lengthwise direction thereof.

The flow path diverter 65 may be included in the spray arm 6, and may selectively open and close a flow of water to the plurality of spray areas. A mounting part 63 onto which the flow path diverter 65 is mounted may be formed at a rotation center of the spray arm 6.

The flow path diverter 65 may be mounted onto the mounting part 63 of the spray arm 6 and may rotate with respect to the mounting part 63 to allow water to flow to any one of the first spray area 61 and the second spray area 62.

As illustrated in FIG. 3, the mounting part 63 may include a central hole 630, a first connecting hole 631 and a second connecting hole 632.

The central hole 630 may be formed in a central portion of the mounting part 63, and a coupling projection 650 formed at the flow path diverter 65 may be fitted into the central hole 630. The flow path diverter 65 may be coupled to the mounting part 63 using the above structure to rotate with respect to the mounting part 63.

The first connecting hole 631 may be respectively formed on both sides of the central portion of the mounting part 63 and may connect to the first spray area 61. In the ordinary wash mode, the first connecting hole 631 may be opened by the flow path diverter 65 and the second connecting hole 632 may be closed by the flow path diverter 65, and water flowing to the spray arm 6 through the first supply path 461 may flow to the first spray area 61 through the first connecting hole 631.

The first spray area 61 may be respectively formed in both end portions of the spray arm 6 with respect to the mounting part 63. Accordingly, the first connecting hole 631 may be disposed respectively on both sides of the central hole 630.

The second connecting hole 632 may be formed circumferentially at a position spaced from the first connecting hole 631 and connected to the second spray area 62. In the intensive wash mode, the second connecting hole 632 may be opened by the flow path diverter 65 while the first connecting hole 631 may be closed by the flow path diverter 65, and water flowing to the spray arm 6 through the first supply path 461 may flow to the second spray area 62 through the second connecting hole 632.

The second spray area 62 may be formed in one end portion the spray arm 6. Accordingly, a single second connecting hole 632 may be disposed between a pair of first connecting holes 631 in a circumferential direction of the mounting part 63.

A first protrusion 633 may be disposed on an outer edge of the mounting part 63. As illustrated in FIG. 3, the first protrusion 633 may have a predetermined width and may be formed to protrude toward the flow path diverter 65 on the outer edge of the mounting part 63 in a ring shape.

The first protrusion 633 may guide the flow path diverter 65 such that the flow path diverter 65 is coupled to the mounting part 63. In this case, the flow path diverter 65 fitted into the mounting part 63 may be guided by the first protrusion 633 and may rotate with respect to the mounting part 63.

A first wall 641 and a second wall 642 may be formed at the spray arm 6. The spray arm 6 may be manufactured to have the first wall 641 and the second wall 642 as a result of molding such that the first wall 641 and the second wall 642 partially block a space formed in the spray arm 6.

The first wall 641, as illustrated in FIG. 3, may be formed in a way that the first wall 641 separates the pair of first connecting holes 631 and the pair of first spray areas 61. For example, the first wall 641 may be formed to separate the pair of first connecting holes 631 at a position where the pair of first connecting holes 631 is circumferentially adjacent to each other, and may be formed from the central hole 630 and to an edge of the spray arm 6 in a transverse direction of the spray arm 6.

The second wall 642, as illustrated in FIG. 3, may separate the first connecting hole 631 and the second connecting hole 632, and separate the first spray area 61 and the second spray area 62. The second spray area 62 may be formed respectively in both end portions of the spray arm 6. Accordingly, the second wall 642 may include a 2-1 wall (6421), and a 2-2 wall (6422).

The 2-1 wall 6421 may be formed from the central hole 630 to the edge of the spray arm 6 in the transverse direction thereof to separate the first connecting hole 631 formed at a position eccentric to one end portion of the spray arm 6, in which the first spray area 61 is only formed with respect to the central hole 630, from the second connecting hole 632 formed circumferentially at a position adjacent to the first connecting hole 631.

The 2-2 wall 6422 may be formed to separate the first connecting hole 631 formed at a position eccentric to the other end portion of the spray arm 6, in which the first spray area 61 and the second spray area 62 are all formed with respect to the central hole 630, from the second connecting hole 632 formed circumferentially at a position adjacent to the first connecting hole 631.

One end of the 2-2 wall 6422 may be formed up to the central hole 630 and the other end may extend in the lengthwise direction of the spray arm 6.

The flow path diverter 65, as illustrated in FIG. 4, may include a coupling projection 650, a dent part 651 and a closing part 652. The flow path diverter 65 may be provided with a hole, to which a rotation shaft of a second actuator 67 is coupled, at a center thereof, and may be rotated with respect to the mounting part 63 of the spray arm 6 by the second actuator 67.

The coupling projection 650 may have a predetermined width and may be formed in a central portion of the flow path diverter 65 to protrude toward the mounting part 63 at a position corresponding to the central hole 630 of the mounting part 63 in a ring shape. The coupling projection 650 may be fitted into the central hole 630 of the mounting part 63, and the flow path diverter 65 may be coupled to the mounting part 63.

The dent part 651 may be formed in a way that the flow path diverter 65 is partially dent on both sides of the coupling projection 650, and as a result of rotation, may selectively open any one of the first connecting hole 631 and the second connecting hole 632.

The closing part 652 may be formed as a portion except for the dent part 651 in the flow path diverter 65, and as a result of rotation, may selectively close any one of the first connecting hole 631 and the second connecting hole 632.

When the dent part 651 overlaps the first connecting hole 631, the closing part 652 may overlap the second connecting hole 632. In this case, water introduced into the spray arm 6 may flow to the first spray area 61 through the first connecting hole 631.

When the dent part 651 overlaps the second connecting hole 632 and the closing part 652 overlaps the first connecting hole 631 as a result of the rotation of the flow path diverter 65, the water introduced into the spray arm 6 may flow to the second spray area 62 through the second connecting hole 632.

A second protrusion 653 may be disposed on an outer edge of the flow path diverter 65. The second protrusion 653 may be formed in a way that the second protrusion 653 having a predetermined width protrudes toward the mounting part 63 along the outer edge of the flow path diverter 65.

The second protrusion 653 may be fitted into the first protrusion 633 of the mounting part 63, and when the flow path diverter 65 rotates with respect to the mounting part 63, the second protrusion 653 may be guided by the first protrusion 633, and the flow path diverter 65 may rotate without escaping from the mounting part 63.

The second protrusion 653 may contact a bottom surface of the mounting part 63 to suppress permeation of water passing through the dent part 651 into the flow path diverter 65 through a gap between the mounting part 63 and the flow path diverter 65 and suppress a flow of the water into the connecting hole closed by the closing part 652.

For example, when the first connecting hole 631 is opened and the second connecting hole 632 is closed by the flow path diverter 65, the second protrusion 653 may suppress a flow of water into the second connecting hole 632 through the gap between the mounting part 63 and the flow path diverter 65. Additionally, the second protrusion 653 may help to reduce a contact surface between the mounting part 63 and the flow path diverter 65, thereby reducing wear on a portion where the mounting part 63 contacts the flow path diverter 65.

As illustrated in FIG. 2, the dishwasher may include a first actuator 66 and a second actuator 67. The first actuator 66 may rotate the spray arm 6, and the second actuator 67 may rotate the flow path diverter 65.

A step motor capable of controlling a rotation angle and a rotation direction precisely may be provided as the first actuator 66 and the second actuator 67, for example.

The rotation shaft of the second actuator 67 may be coupled to the center of the flow path diverter 65. Accordingly, the flow path diverter 65 may be rotated by the second actuator 67 with respect to the mounting part 63.

To prevent the first actuator 66 from interfering with the rotation of the second actuator 67, a rotation shaft of the first actuator 66 may be spaced from the rotation center of the spray arm 6.

A first gear 691 may be coupled to the rotation center of the spray arm 6. The spray arm 6 may rotate as a result of rotation of the first gear 691, but the flow path diverter 65 may not be affected by the rotation of the first gear 691.

A second gear 692 may be coupled to the rotation shaft of the first actuator 66, and the first gear 69 and the second gear 692 may be coupled to each other. In the structure, the spray arm 6 may rotate, as a result of operation of the first actuator 66.

The rotation shaft of the second actuator 67 may be coupled to a rotation center of the flow path diverter 65 to rotate the flow path diverter 65. The flow path diverter 65 may selectively open any one of the first connecting hole 631 and the second connecting hole 632 as a result of rotation of the dent part 651.

Figure 5:
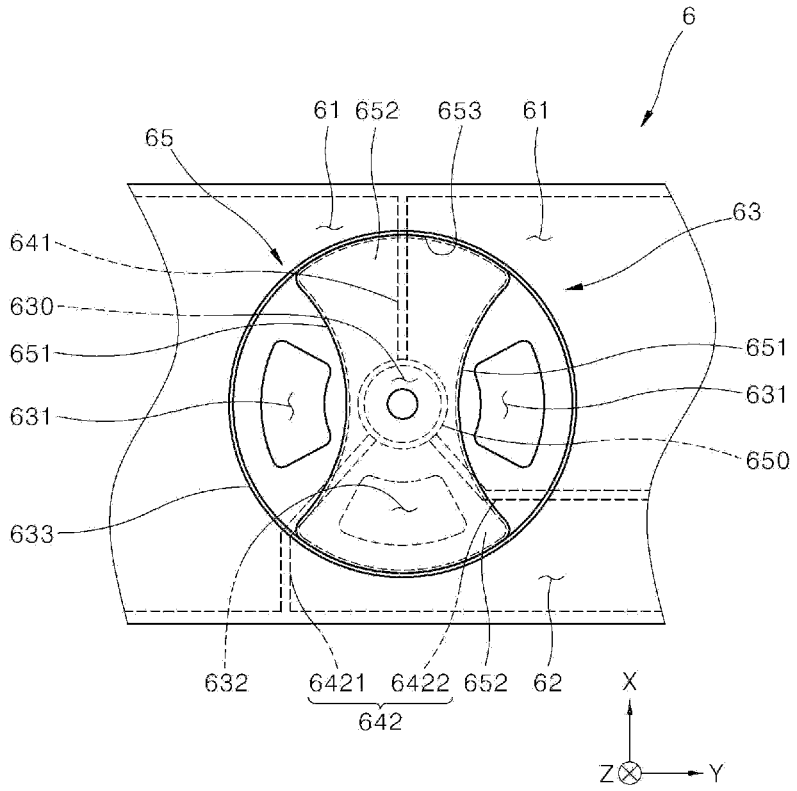
FIG. 5 is a bottom view showing a flow path diverter coupled to a spray arm in a state in which a first spray area is opened while a second spray area is closed.
Figure 6:
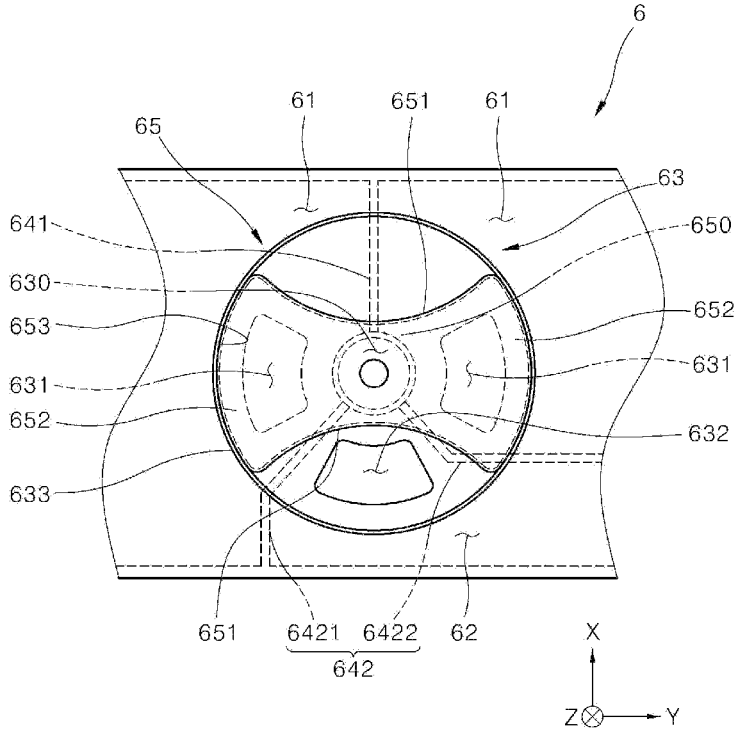
FIG. 6 is a bottom view showing a flow path diverter coupled to a spray arm in a state in which a first spray area is closed while a second spray area is opened.

FIG. 5 is a bottom view showing a flow path diverter 65 coupled to a spray arm 6 in a state in which a first spray area 61 is opened while a second spray area 62 is closed. FIG. 6 is a bottom view showing a flow path diverter 65 coupled to a spray arm 6 in a state in which a first spray area 61 is closed while a second spray area 62 is opened.

As illustrated in FIG. 5, the dent part 651 of the flow path diverter 65 may overlap a first spray hole 611, and the closing part 652 of the flow path diverter 65 may overlap a second spray hole 621. In this case, the first spray hole 611 may be opened, and the second spray hole 621 may be closed. Accordingly, water flowing into the spray arm 6 may flow to the first spray area 61 through the first spray hole 611, and the dishwasher may operate in the ordinary wash mode.

As illustrated in FIG. 6, the flow path diverter 65 may be rotated by the second actuator 67 in the state of FIG. 5, and the dent part 651 may overlap the second spray hole 621, and the closing part 652 may overlap the first spray hole 611. In this case, the first spray hole 611 may be closed, and the second spray hole 621 may be opened. Accordingly, water flowing into the spray arm 6 may flow to the second spray area 62 through the second spray hole 621, and the dishwasher may operate in the intensive wash mode.

Figure 7:
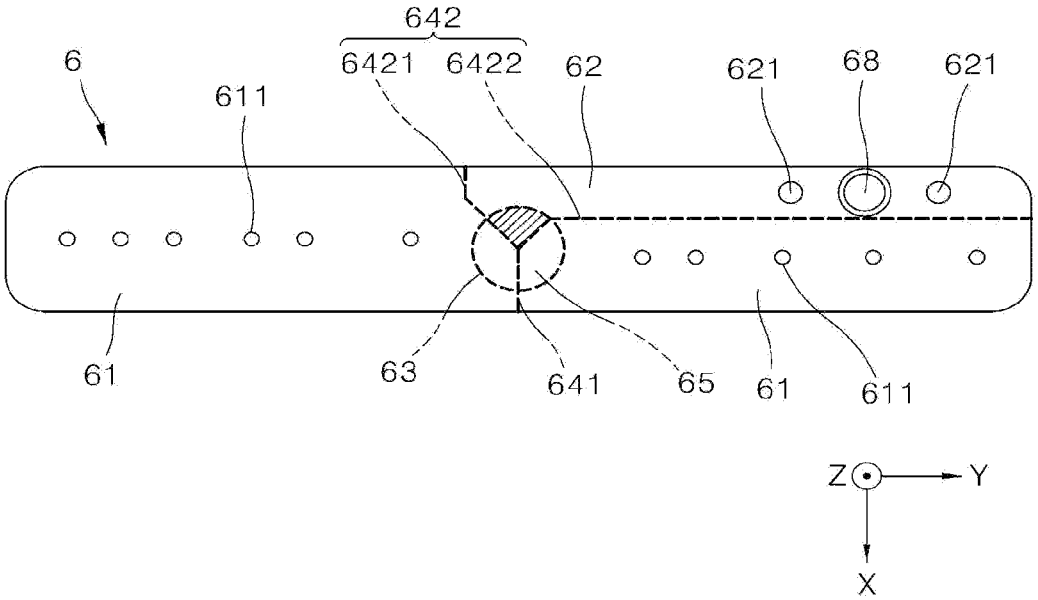
FIG. 7 is a schematic view showing a spray arm in a state in which a first spray area is opened while a second spray area is closed.
Figure 8:
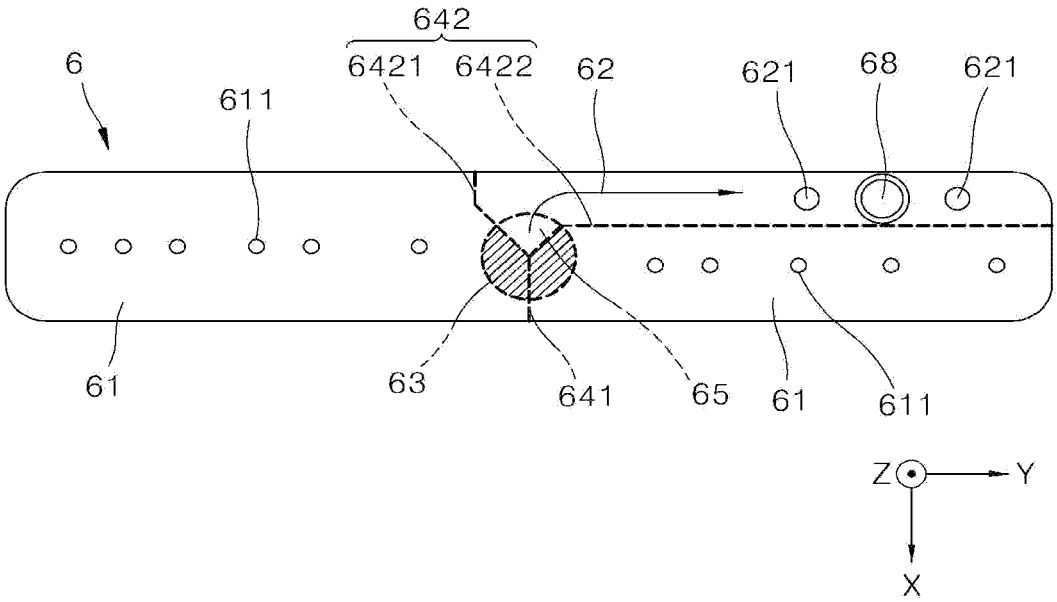
FIG. 8 is a schematic view showing a spray arm in a state in which a first spray area is closed while a second spray area is opened.

FIGS. 7 and 8 are plan views schematically showing a spray arm 6. The spray arm 6 may be entirely formed into a bar having a length corresponding to a length of the lower rack 51.

The first spray area 61 may be disposed in both end portions of the spray arm 6 with respect to the rotation center of the spray arm 6. The second spray area 62 may be disposed in one end portion of the spray arm 6 in a way that the second spray area is separate from the first spray area 61. In this case, the second wall 642 may be formed between the first spray area 61 and the second spray area 62, and the first spray area 61 may be separated from the second spray area 62 by the second wall 642.

A plurality of first spray holes 611, through which water sprays, may be formed in the first spray area 61. Each of the first spray holes 611 may be spaced in the lengthwise direction of the spray arm 6.

In the ordinary wash mode, water may spray through the first spray holes 611. Since in the ordinary wash mode, the cooking vessels stored in the lower rack 51 are entirely washed, the first spray holes 611 may be formed in a way that the first spray holes are spaced from one another across the spray arm 6 in the lengthwise direction of the spray arm 6 at relatively regular intervals.

However, the first spray holes 611 formed in both end portions of the spray arm 6 may not necessarily be disposed at symmetrical positions of both end portions, and a distance between the first spray holes 611 may not necessarily be the same.

Additionally, at least one of second spray holes 621, through which water sprays, may be formed in the second spray area 62. In the intensive wash mode, water may spray through the second spray hole 621. In the intensive wash mode, cooking vessels with remaining contaminants, among the cooking vessels stored in the lower rack 51, may be washed.

That is, in the intensive wash mode, water may spray only toward a specific position of the lower rack 51 on which the cooking vessels with remaining contaminants are placed. Thus, the second spray hole 621 may be formed only in a specific area of the spray arm 6, for example.

When a plurality of second spray holes 621 are provided, the second spray holes 621 may be disposed densely in a specific area of the spray arm 6. Since the second spray holes 621 are densely disposed in a specific area of the spray arm 6, water may intensively spray to a cooking vessel with remaining contaminants, thereby ensuring improvement in washing efficiency.

The dishwasher may further include a camera 68 disposed on the spray arm 6. The camera 68 may detect the position of a cooking vessel with remaining contaminants, among the cooking vessels stored in the lower rack 51, after the ordinary wash mode ends.

The camera 68 may capture an image, and the captured image may be transmitted to a controller included in the dishwasher. The controller may perceive the saturation, brightness, shape and the like of contaminants attached onto a cooking vessel from the transmitted image, and may ascertain the position of the cooking vessel with the remaining contaminants to be washed.

Any sort of camera may be used as the camera 68 as long as the camera 68 captures an image such that the controller ascertains whether there are remaining contaminants.

In the intensive wash mode, the controller may rotate the spray arm 6 as a result of control over operation of the first actuator 66 such that the second spray hole 621 approaches to a cooking vessel with remaining contaminants. In this case, the controller may dispose the camera 68 near the cooking vessel with remaining contaminants to accurately ascertain the position of the cooking vessel with remaining contaminants based on an image transmitted from the camera 68. As the camera 68 becomes closer to the cooking vessel with remaining contaminants, the controller may accurately ascertain the position and state of the contaminants from a captured image.

Additionally, to improve washing efficiency in the intensive wash mode, the second spray area 62 and the second spray hole 621 need to approach the cooking vessel with remaining contaminants. For the above-mentioned reasons, the camera 68 and the second spray area 62 may be disposed at the same position of the spray arm 6, for example.

Accordingly, the camera 68 may be disposed in the second spray area 62.

Further, for the above reasons, the camera 68 and the second spray hole 621 may be disposed at the same position of the spray arm 6, for example. Thus, the camera 68 may be disposed near the second spray hole 621.

FIG. 7 is a schematic view showing a spray arm 6 in a state in which a first spray area 61 is opened while a second spray area 62 is closed. A coupling between the flow path diverter 65 and the spray arm 6 schematically illustrated in FIG. 7 is the same as that in FIG. 5.

Hatched portions in FIGS. 7 and 8 denote a closed flow path.

In a state of FIG. 7, water introduced into the spray arm 6 may pass through the first spray hole 611, flow to a pair of first spray areas 61 formed in both end portions of the spray arm 6 and spray through the first spray holes 611.

In the state of FIG. 7, operation in the ordinary wash mode may be performed, and during the operation in the ordinary wash mode, the spray arm 6 may rotate as a result of operation of the first actuator 66 to wash cooking vessels stored in the lower rack 51 entirely.

FIG. 8 is a schematic view showing a spray arm 6 in a state in which a first spray area 61 is closed while a second spray area 62 is opened. A coupling between the flow path diverter 65 and the spray arm 6 schematically illustrated in FIG. 8 is the same as that in FIG. 6.

In a state of FIG. 8, water introduced into the spray arm 6 may pass through the second spray hole 621, flow to the second spray area 62 formed in one end portion of the spray arm 6 and spray through the second spray hole 621, as indicated by the arrow.

In the state of FIG. 8, operation in the intensive wash mode may be performed, and during the operation in the intensive wash mode, the second spray hole 621 may approach a position, where a cooking vessel with remaining contaminants is placed, as a result of operation of the first actuator 66 to wash the remaining contaminants.

In the intensive wash mode, the spray arm 6 may spray water without rotating at a standstill. Alternatively, to improve the washing efficiency, the spray arm 6 may spray water in a state in which the spray arm 6 makes reciprocating rotations such that the second spray hole 621 makes reciprocating rotations at a position near the contaminants within a range of predetermined angles.

Figure 9:
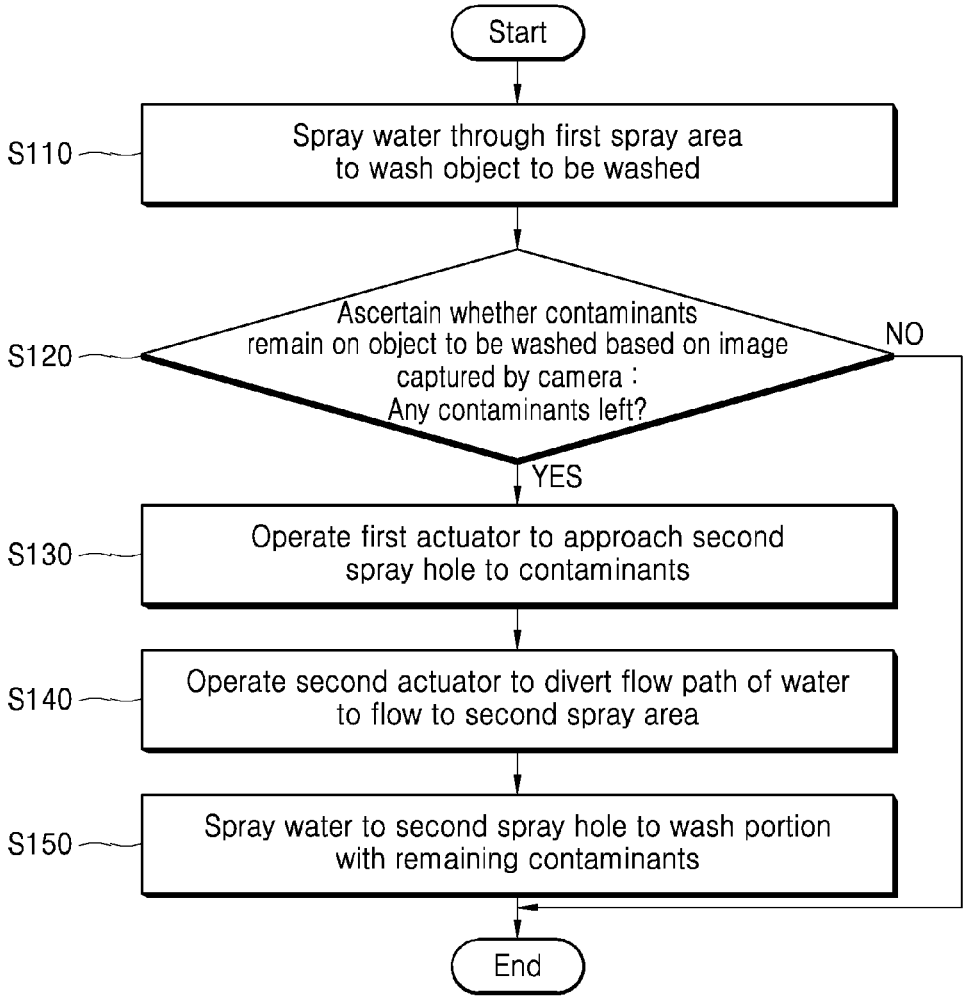
FIG. 9 is a flow chart showing a control method of a dishwasher in one embodiment.

FIG. 9 is a flow chart showing a control method of a dishwasher in one embodiment. The controller included in the dishwasher may connect to the water supply pump 45, the first actuator 66, the second actuator 67, the camera 68 and the like in a communicable manner and may control the same, to perform each step of the control method of the dishwasher in the embodiment.

The controller may operate the water supply pump 45 to spray water through the first spray area 61 disposed at the spray arm 6 and wash an object to be washed (S110).

In step 110 (S110), the dishwasher may operate in the ordinary wash mode. In this case, the spray arm 6 may rotate, water may spray from the first spray area 61, and cooking vessels stored in the lower rack 51 may be washed entirely. The controller may stop the operation of the water supply pump 45 to end step 110.

After step 110 ends, the controller may determine whether contaminants are left on the object to be washed from an image captured by the camera 68 disposed at the spray arm 6 (S120).

The controller may receive an image from the camera 68 disposed at the spray arm 6 in step 110, and when necessary, may rotate the spray arm 6 as a result of operation of the first actuator 66 to receive an image of the cooking vessels stored in the lower rack 51 from the camera 68 after step 110 ends.

The controller may perceive the saturation, brightness, shape and the like of contaminants attached onto a cooking vessel from the transmitted image to ascertain whether contaminants remain on a cooking vessel and the position of the cooking vessel with the remaining contaminants to be washed.

When no contaminants remain on the cooking vessel, the process of washing a cooking vessel may end, and when contaminants remain on the cooking vessel, the next step may be performed.

The controller may operate the first actuator 66 and allow the second spray hole 621, disposed in the second spray area 62 of the spray arm 6, to approach the contaminants (S130).

The controller may rotate the spray arm 6 at a predetermined angle as a result of control over the first actuator 66 to allow the second spray hole 621 to approach the contaminants as close as possible. In this case, since the camera 68 is disposed near the second spray hole 621, the camera 68 may also approach the contaminants.

The controller may operate the second actuator 67 and divert a flow path of water such that the flow path diverter 65 disposed at the spray arm 6 blocks a flow of the water to the first spray area 61 and allows the water to flow to the second spray area 62 (S140).

In step 140, the flow path diverter 65 may close the first connecting hole 631 and open the second connecting hole 632 to prepare for intensive washing for removing remaining contaminants.

Regarding the control method of the dishwasher in the embodiment, any one of step 130 and step 140 may be performed first. Accordingly, step 130 may be performed before step 140, step 140 may be performed before step 130 or step 130 and step 140 may be performed at the same time.

When the controller operates the water supply pump 45 again, the spray arm 6 may spray water through the second spray hole 621 to wash the cooking vessel with remaining contaminants (S150).

In step 150, water introduced into the spray arm 6 may flow through the second spray area 62 and spray through the second spray hole 621 to intensively wash the cooking vessel with remaining contaminants.

The spray arm 6 may stop without rotating in step 150 such that the second spray hole 621 stays near the cooking vessel with remaining contaminants, thereby improving the washing efficiency.

Alternatively, in step 150, the controller may allow the spray arm 6 to make reciprocating rotations as a result of control over operation of the first actuator 66 such that the second spray hole 621 makes reciprocating rotations near the contaminants within a range of predetermined angles, thereby improving the washing efficiency further.

In step 150, the camera 68 may capture an image of a portion with remaining contaminants during the wash process. The controller may receive the transmitted image, and when ascertaining the remaining contaminants are removed based on the image, may end step 150.

The dishwasher may perform step 120 or step 150 to wash the cooking vessel with remaining contaminants in the intensive wash mode.

When a plurality of cooking vessels remaining contaminants is placed at different positions in the lower rack 51, the controller may wash each of the cooking vessels in the intensive wash mode consecutively. Since the flow path diverter operates such that water sprays to the second spray area 62 after a first operation in the intensive wash mode ends, step 120, step 130 and step 150 may be performed while step 140 is omitted.

In the embodiment, the spray arm 6 may be provided with the first spray area 61 and the second spray area 62 separately, and may spray water to the first spray area 61 in the ordinary wash mode and spray water to the second spray area 62 in the intensive wash mode to wash an object to be washed, thereby removing contaminants left on a cooking vessel effectively.

In the embodiment, the camera 68 may be disposed in the first spray area of the spray arm 6. Accordingly, the camera 68 may approach a position with remaining contaminants, to ascertain whether there are contaminants, a position where contaminants are present and the like more accurately through the camera 68.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

DESCRIPTION OF REFERENCE NUMERAL

1: Dishwasher
2: Wash tub
3: Door
4: Sump
45: Water supply pump
5: Storage
51: Lower rack
6: Spray arm
61: First spray area
611: First spray hole
62: Second spray area

621: Second spray hole
63: Mounting part
630: Central hole
631: First connecting hole
632: Second connecting hole
633: First protrusion
641: First wall
642: Second wall
6421: 2-1 wall
6422: 2-2 wall
65: Flow path diverter
650: Coupling projection
651: Dent part
652: Closing part
653: Second protrusion
66: First actuator
67: Second actuator
68: Camera
691: First gear
692: Second gear

The invention claimed is:

1. A dishwasher, comprising:

a wash tub to accommodate an object to be washed;

a spray arm rotatably disposed within the wash tub, the spray arm configured to spray water towards the object and including a plurality of separate spray areas;

a flow path diverter disposed at the spray arm and configured to selectively open and close a flow of water to the plurality of separate spray areas;

a first actuator to rotate the spray arm;

a second actuator to rotate the flow path diverter; and a camera disposed on the spray arm, wherein the plurality of separate spray areas comprise a first spray area, and a second spray area, wherein the second spray area has at least one of an amount of sprayed water and a spray speed greater than that of the first spray area, wherein the first spray area includes first end portions of the spray arm with respect to the rotation center of the spray arm, and wherein the second spray area is disposed in one end portion of the spray arm such that the second spray area is separate from the first spray area.

2. The dishwasher of claim 1, wherein the spray arm is provided, at a rotation center thereof, with a mounting part, onto which the flow path diverter is mounted, and wherein the mounting part comprises:

a central hole, which is formed in a central portion of the mounting part, to fit a coupling projection formed on the flow path diverter;

first connecting holes formed respectively on both sides of the central portion and connected to the first spray area; and a second connecting hole circumferentially spaced from the first connecting hole and connected to the second spray area.

3. The dishwasher of claim 2, wherein the spray arm comprises:

a first wall configured to separate the first connecting holes and a pair of first spray areas; and a second wall configured to separate the first connecting hole and the second connecting hole, and separate the pair of first spray areas and the second spray area.

4. The dishwasher of claim 2, wherein the flow path diverter comprises:

the coupling projection protruding toward the mounting part in a ring shape at a position corresponding to the central hole of the mounting part in a central portion of the flow path diverter;

a dented portion formed such that the flow path diverter is partially dented on both sides of the coupling projection, and configured to selectively open any one of the first connecting hole and the second connecting hole as a result of rotation; and a closing portion including portions of the flow path diverter away from the dented portion, and configured to selectively close any one of the first connecting hole and the second connecting hole as a result of rotation.

5. The dishwasher of claim 4, wherein the mounting part is provided with a first protrusion, which is configured to guide the flow path diverter such that the flow path diverter is coupled to the mounting part and protrudes toward the flow path diverter in a ring shape, on an outer edge thereof, and wherein the flow path diverter is provided with a second protrusion, which has a predetermined width and protrudes toward the mounting part along an outer edge of the flow path diverter, on the outer edge thereof.

6. The dishwasher of claim 4, wherein a rotation shaft of the second actuator is coupled to a rotation center of the flow path diverter such that the second actuator rotates the flow path diverter, and wherein the flow path diverter selectively opens and closes any one of the first connecting hole and the second connecting hole as a result of rotation of the dented portion.

7. The dishwasher of claim 6, wherein a rotation shaft of the first actuator is spaced from the rotation center of the spray arm, a first gear is coupled to the rotation center of the spray arm, a second gear is coupled to the rotation shaft of the first actuator, and the first gear and the second gear are coupled to each other.

8. The dishwasher of claim 1, wherein the camera is disposed in the second spray area.

9. The dishwasher of claim 8, wherein the spray arm is formed into a barn.

10. The dishwasher of claim 9, wherein a plurality of first spray holes through which water sprays is formed in the first spray area, and at least one of second spray holes through which water sprays is formed in the second spray area, and wherein the first spray holes are disposed in a lengthwise direction of the spray arm at intervals, and when a plurality of second spray holes are provided, the second spray holes are densely disposed in a specific area of the spray arm.

11. The dishwasher of claim 9, wherein at least one of second spray holes through which water sprays is formed in the second spray area, and the camera is disposed near the at least one of the second spray holes.

* * * * *